US006789596B1

(12) United States Patent
Lin

(10) Patent No.: US 6,789,596 B1
(45) Date of Patent: Sep. 14, 2004

(54) CURTAIN DEVICE

(76) Inventor: Shih-Ming Lin, No. 33, Nan-Ching-Nung-Chang, Ching-Ho Tsun, Shui-Shang, Chia-Yi Hsien (TW)

( * ) Notice: Subject to any disclaimer, the term of this patent is extended or adjusted under 35 U.S.C. 154(b) by 0 days.

(21) Appl. No.: 10/371,454

(22) Filed: Feb. 21, 2003

(51) Int. Cl.[7] ..... A47H 1/00

(52) U.S. Cl. ..... 160/89; 160/84.01; 160/168.1 V

(58) Field of Search ..... 160/89, 84.04, 160/84.01, 168.1 V, 173 V, 900, 348, 349.1, 349.2

(56) References Cited

U.S. PATENT DOCUMENTS 3,399,714 A * 9/1968 Farrell ..... 160/348
3,844,330 A * 10/1974 Hyman ..... 160/168.1 V
3,851,699 A * 12/1974 Shapiro ..... 160/168.1 V
4,911,220 A * 3/1990 Hiller ..... 160/236
5,012,552 A * 5/1991 Wulf ..... 16/87.4 R
5,297,607 A * 3/1994 Beauchamp ..... 160/84.04
5,638,880 A * 6/1997 Colson et al. ..... 160/84.01
5,715,883 A * 2/1998 Keith ..... 160/89
6,186,213 B1 * 2/2001 Senesac ..... 160/89
6,334,477 B1 * 1/2002 Moir ..... 160/168.1 V
6,510,885 B1 * 1/2003 Shih ..... 160/89
6,675,858 B2 * 1/2004 Marocco ..... 160/89

* cited by examiner

*Primary Examiner*—David Purol
(74) *Attorney, Agent, or Firm*—Ladas & Parry

(57) ABSTRACT

A curtain device includes a plurality of Venetian blind slats, a plurality of curtain units, a plurality of anchoring members, and a plurality of fastening members. Each of the anchoring members is mounted on a respective one of the curtain units. The anchoring members anchor the curtain units on top edges of the Venetian blind slats. Each of the fastening members fastens removably a curtain portion of a respective one of the curtain units to a curtain portion of an adjacent one of the curtain units.

18 Claims, 4 Drawing Sheets

CURTAIN DEVICE

BACKGROUND OF THE INVENTION

1. Field of the Invention

The invention relates to a curtain device, more particularly to a curtain device having curtain units that can be easily and removably installed onto vertically extending Venetian blind slats.

2. Description of the Related Art

A conventional vertically extending Venetian blind primarily includes a headrail, a plurality of carrier slides slidable along a longitudinal direction of the headrail, and a plurality of slats, each of which is hung on a respective one of the carrier slides. When the slats are extended to block incoming light, each of the slats is rotatable within a predetermined angular range about a pivot axis of the respective one of the carrier slides so as to regulate the amount of the light blocked by the slats.

It is noted that the appearance of the aforesaid conventional Venetian blind is limited by the slats, and is thus devoid of versatility.

SUMMARY OF THE INVENTION

The main object of the present invention is to provide a curtain device having curtain units that can be easily and removably installed onto vertically extending Venetian blind slats. The fabric material for the curtain units can vary so as to enhance versatility of a Venetian blind without affecting basic operation of the latter.

According to one aspect of this invention, a curtain device includes a plurality of Venetian blind slats, a plurality of curtain units, a plurality of anchoring members, and a plurality of fastening members.

Each of the Venetian blind slats has a top edge and a bottom edge opposite to the top edge in a vertical direction.

The curtain units are arranged in a horizontal direction. Each of the curtain units includes a first curtain portion having a first vertical edge and a second vertical edge opposite to the first vertical edge, and a second curtain portion having a first vertical edge connected to the second vertical edge of the first curtain portion, and a second vertical edge opposite to the first vertical edge of the second curtain portion and connected to the first vertical edge of the first curtain portion of an adjacent one of the curtain units such that the second curtain portion cooperates with the first curtain portion of the adjacent one of the curtain units to confine an accommodation space for accommodating a respective one of the Venetian blind slats therein.

Each of the anchoring members is mounted on a respective one of the curtain units. The anchoring members anchor the curtain units on the top edges of the Venetian blind slats in the accommodation spaces, respectively.

Each of the fastening members fastens removably the second curtain portion of a respective one of the curtain units to the first curtain portion of the adjacent one of the curtain units at an upper end of the accommodation space.

According to another aspect of this invention, there is provided a curtain device for a plurality of Venetian blind slats, each of which has a top edge and a bottom edge opposite to the top edge in a vertical direction. The curtain device includes a plurality of curtain units, a plurality of anchoring units, and a plurality of fastening members.

The curtain units are arranged in a horizontal direction. Each of the curtain units includes a first curtain portion having a first vertical edge and a second vertical edge opposite to the first vertical edge, and a second curtain portion having a first vertical edge connected to the second vertical edge of the first curtain portion, and a second vertical edge opposite to the first vertical edge of the second curtain portion and connected to the first vertical edge of the first curtain portion of an adjacent one of the curtain units such that the second curtain portion cooperates with the first curtain portion of the adjacent one of the curtain units to confine an accommodation space that is adapted to accommodate a respective one of the Venetian blind slats therein.

Each of the anchoring members is mounted on a respective one of the curtain units. The anchoring members are adapted to anchor the curtain units on the top edges of the Venetian blind slats in the accommodation spaces, respectively.

Each of the fastening members fastens removably the second curtain portion of a respective one of the curtain units to the first curtain portion of the adjacent one of the curtain units at an upper end of the accommodation space.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
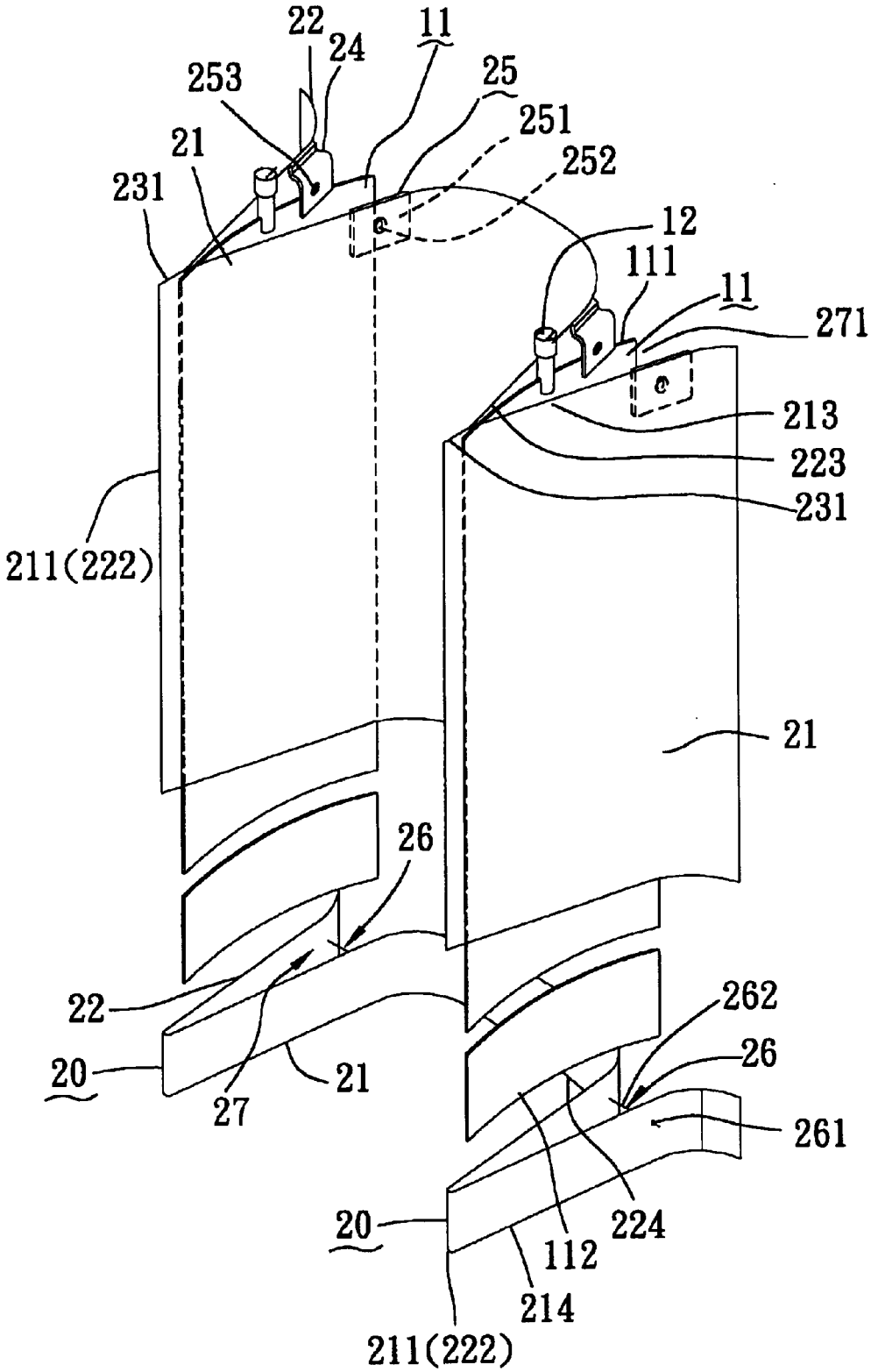
FIG. 1 is a fragmentary perspective view of the first preferred embodiment of the curtain device according to this invention.

Before the present invention is described in greater detail, it should be noted that like elements are denoted by the same reference numerals throughout the disclosure.

Figure 2:
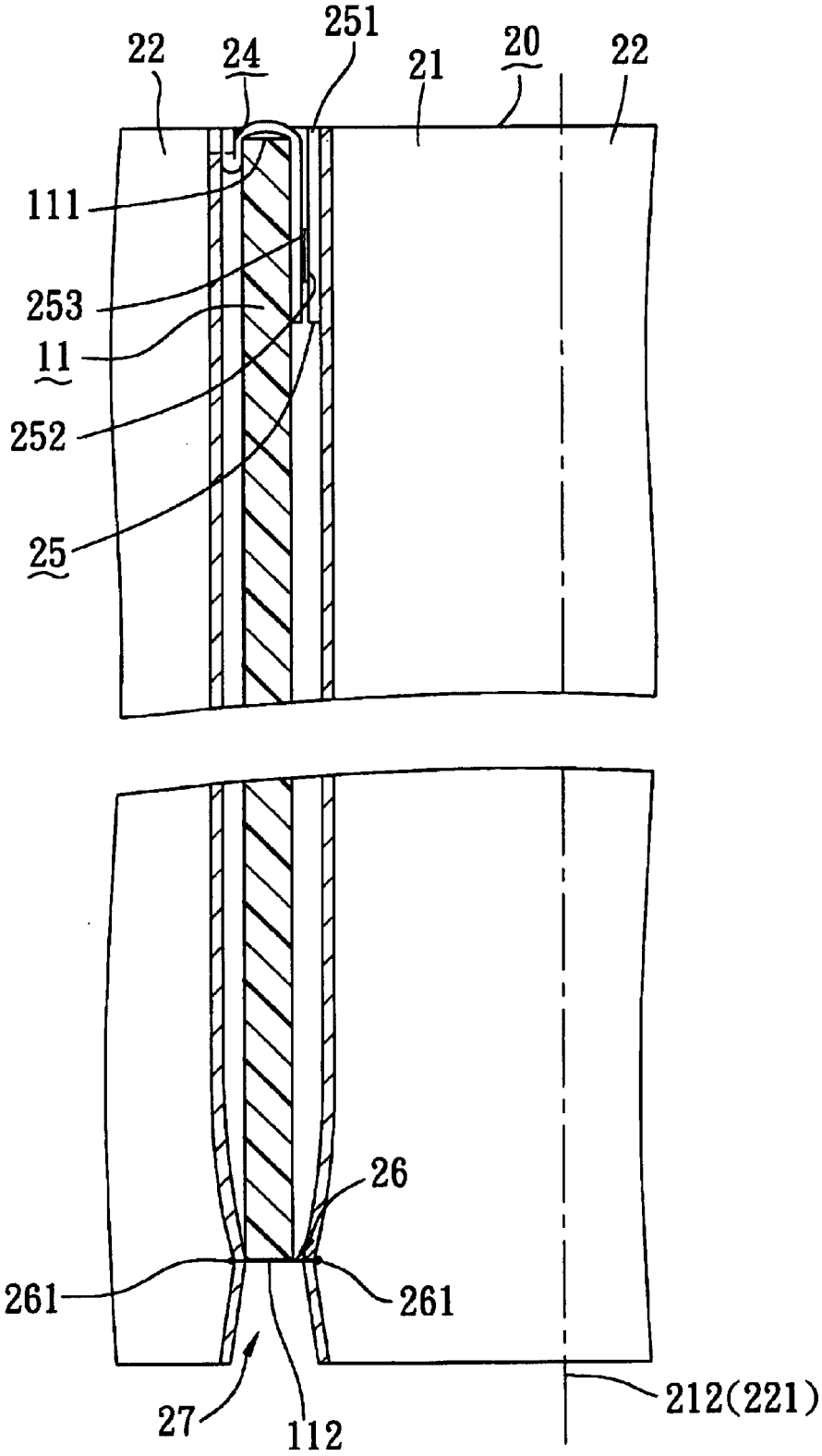
FIG. 2 is a fragmentary sectional view of the first preferred embodiment.

Referring to FIGS. 1 and 2, the first preferred embodiment of the curtain device according to this invention is shown to include a plurality of Venetian blind slats 11, a plurality of curtain units 20, a plurality of anchoring members 24, and a plurality of fastening members 25.

Each of the Venetian blind slats 11 is installed in a conventional manner on a headrail (not shown) by a respective one of a plurality of carrier slides 12, and is slidable along the headrail. Each of the Venetian blind slats 11 has a top edge 111 and a bottom edge 112 opposite to the top edge 111 in a vertical direction.

The curtain units 20 are arranged in a horizontal direction. Each of the curtain units 20 includes a first curtain portion 21 having a first vertical edge 211 and a second vertical edge 212 (see FIG. 2) opposite to the first vertical edge 211, and a second curtain portion 22 having a first vertical edge 221 (see FIG. 2) connected to the second vertical edge 212 of the first curtain portion 21, and a second vertical edge 222 opposite to the first vertical edge 221 of the second curtain portion 22 and connected to the first vertical edge 211 of the first curtain portion 21 of an adjacent one of the curtain units 20 such that the second curtain portion 22 cooperates with the first curtain portion 21 of the adjacent one of the curtain units 20 to confine an accommodation space 27 for accommodating a respective one of the Venetian blind slats 11 therein.

Each of the first and second curtain portions 21,22 further has a top edge 213,223. The top edge 223 of the second curtain portion 22 of each of the curtain units 20 has a section sewn to the top edge 213 of the first curtain portion 21 of the adjacent one of the curtain units 20 proximate to the second vertical edge 222 of the second curtain portion 22 to form a hanging segment 231 for hanging on the top edge 111 of the respective one of the Venetian blind slats 11 in the accommodation space 27.

Each of the anchoring members 24 is formed as a flexible plate, and is mounted on a respective one of the curtain units 20 by any suitable manner, such as, by sewing. The anchoring members 24 anchor the curtain units 20 on the top edges 111 of the Venetian blind slats 11 in the accommodation spaces 27, respectively.

Each of the fastening members 25 fastens removably the second curtain portion 22 of a respective one of the curtain units 20 to the first curtain portion 21 of the adjacent one of the curtain units 20 at an upper end 271 of the accommodation space 27.

Each of the fastening members 25 includes a first fastening unit 253 mounted on the second curtain portion 22 of the respective one of the curtain units 20, and a second fastening unit 252 mounted on the first curtain portion 21 of the adjacent one of the curtain units 20. In this embodiment, as best shown in FIG. 1, the first fastening unit 253 is a male fastener, and is formed directly on a respective one of the anchoring members 24. Each fastening member 25 further includes a plate 251 mounted on the first curtain portion 21 of the adjacent one of the curtain units 20 by any suitable manner (such as, by sewing). The second fastening unit 252 is a female fastener, and is formed on the plate 251. The second fastening unit 252 is fastened removably to and is pivotable relative to the first fastening unit 253 about a horizontal pivot axis.

Each of the first and second curtain portions 21,22 has a length in the vertical direction longer than that of the Venetian blind slats 11, and further has a bottom edge 214, 224 disposed under the bottom edge 112 of the respective one of the Venetian blind slats 11 in the accommodation space 27. The curtain device further comprises a plurality of string units 26, each of which includes two opposite end knots 261 and an intermediate string portion 262 between the end knots 261. The intermediate string portion 262 is strung through the bottom edge 224 of the second curtain portion 22 of a respective one of the curtain units 20 and the bottom edge 214 of the first curtain portion 21 of the adjacent one of the curtain units 20.

Figure 3:
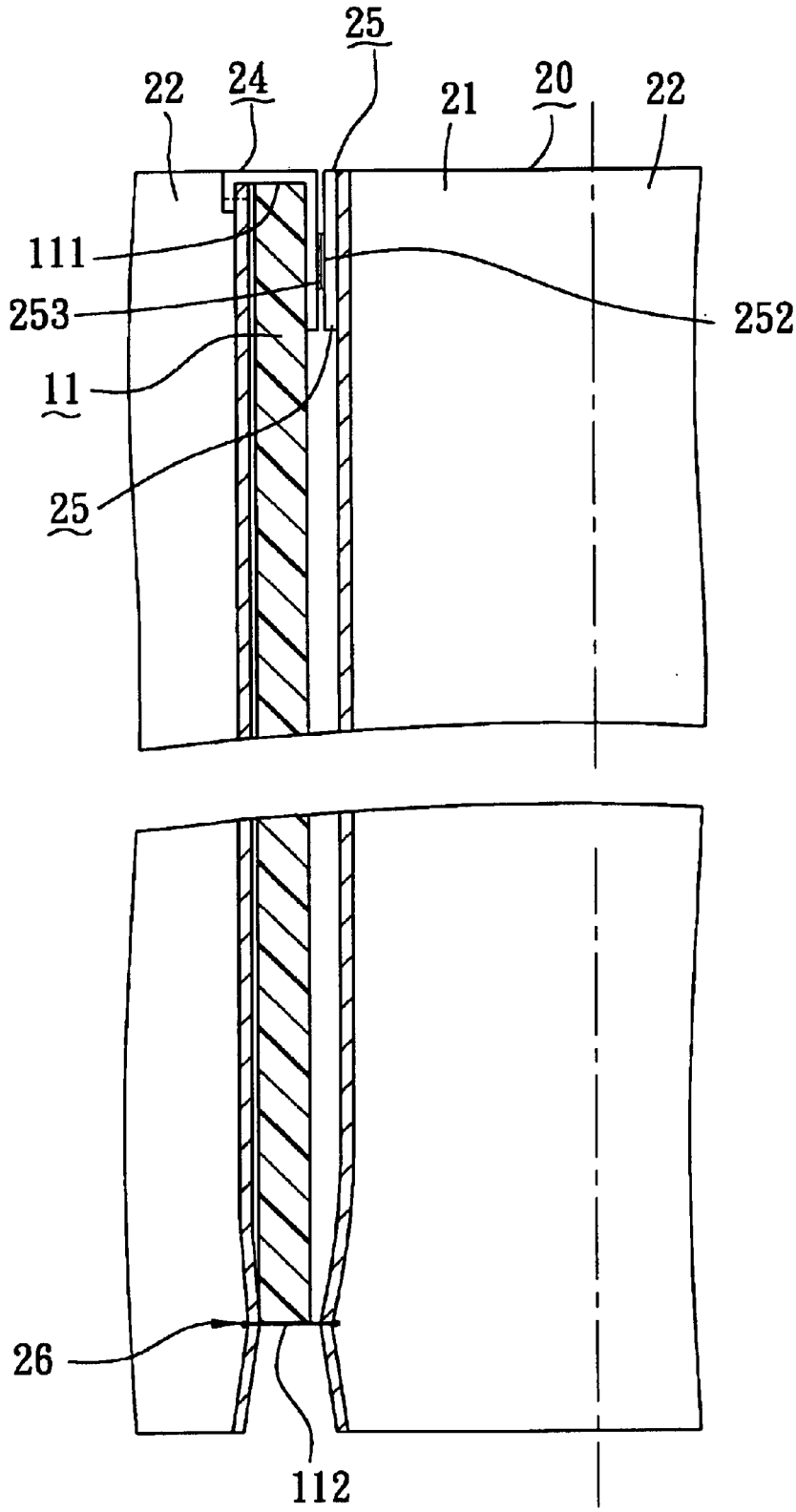
FIG. 3 is a fragmentary sectional view of the second preferred embodiment of the curtain device according to this invention.

Referring to FIG. 3, the second preferred embodiment of the curtain device according to this invention is substantially identical to the first preferred embodiment described above, except that the configuration of the anchoring member 24 is slightly different from that of the first preferred embodiment.

Figure 4:
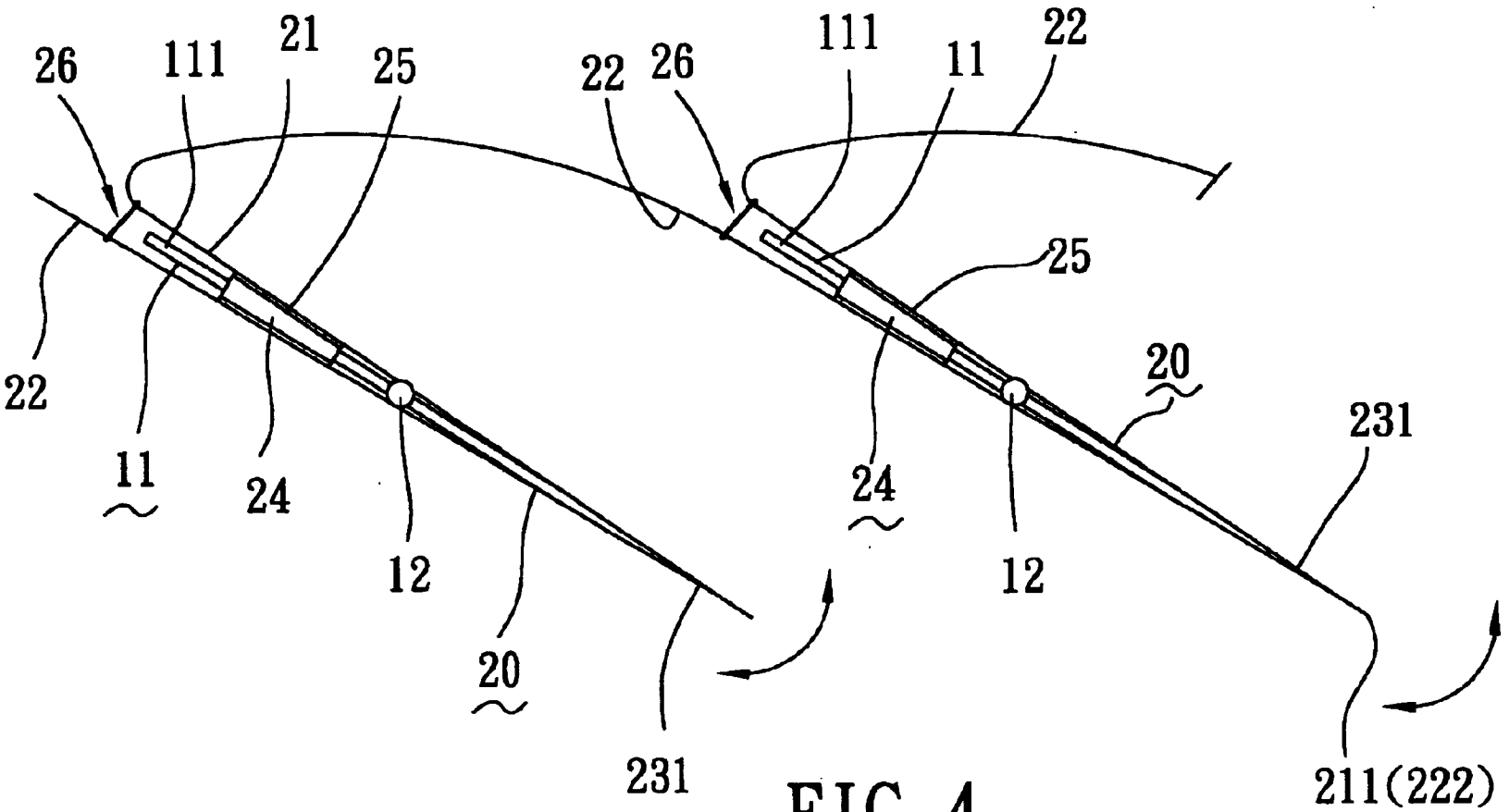
FIG. 4 is a fragmentary top view of the first preferred embodiment.

Referring to FIG. 4, preferably, each of the curtain units 20 has a width in the horizontal direction that is at least 1.5 times that of the Venetian blind slats 11 so that the Venetian blind slats 11 can be rotated about the carrier slides 12, respectively, to regulate the amount of the blocked light. Moreover, the material for the curtain units 20 can be selected according to the specific purpose. Therefore, the curtain units 20 can be made of transparent fabric material, translucent fabric material, or opaque fabric material.

In view of the aforesaid, the curtain device of this invention can enhance the appearance of the Venetian blind without affecting the basic operation of the Venetian blind.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A curtain device, comprising:

a plurality of Venetian blind slats, each of which has a top edge and a bottom edge opposite to said top edge in a vertical direction;

a plurality of curtain units arranged in a horizontal direction, each of said curtain units including a first curtain portion having a first vertical edge and a second vertical edge opposite to said first vertical edge, and a second curtain portion having a first vertical edge connected to said second vertical edge of said first curtain portion, and a second vertical edge opposite to said first vertical edge of said second curtain portion and connected to said first vertical edge of said first curtain portion of an adjacent one of said curtain units such that said second curtain portion cooperates with said first curtain portion of the adjacent one of said curtain units to confine an accommodation space for accommodating a respective one of said Venetian blind slats therein;

a plurality of anchoring members, each of which is mounted on a respective one of said curtain units, said anchoring members anchoring said curtain units on said top edges of said Venetian blind slats in said accommodation spaces, respectively; and a plurality of fastening members, each of which fastens removably said second curtain portion of a respective one of said curtain units at an upper end of said accommodation space;

wherein each of said first and second curtain portions has a length in the vertical direction longer than that of said Venetian blind slats and further has a bottom edge disposed under said bottom edge of the respective one of said Venetian blind slats in said accommodation space, said curtain device further comprising a plurality of sting units, each of which includes two opposite end knots and an intermediate string portion between said and knots, said intermediate string portion being strung through said bottom edge of said second curtains portion of a respective one of said curtain units and said bottom edge of said first curtain portion of the adjacent one of said curtain units.

2. The curtain device as claimed in claim 1, wherein each of said first and second curtain portions further has a top edge, said top edge of said second curtain portion of each of said curtain units having a section sewn to said top edge of said first curtain portion of the adjacent one of said curtain units proximate to said second vertical edge of said second curtain portion to form a hanging segment for hanging on said top edge of the respective one of said Venetian blind slats in said accommodation space.

3. The curtain device as claimed in claim 1, wherein each of said fastening members includes a first fastening unit mounted on said second curtain portion of the respective one of said curtain units, and a second fastening unit mounted on said first curtain portion of the adjacent one of said curtain units, said second fastening unit being fastened removably to and being pivotable relative to said first fastening unit about a horizontal pivot axis.

4. The curtain device as claimed in claim 3, wherein said first and second fastening units are male and female fasteners, respectively.

5. The curtain device as claimed in claim 4, wherein one of said first and second fastening units is formed directly on a respective one of said anchoring members.

6. The curtain device as claimed in claim 1, wherein each of said curtain units has a width in the horizontal direction that is at least 1.5 times that of said Venetian blind slats.

7. The curtain device as claimed in claim 1, wherein said curtain units are made of transparent fabric material.

8. The curtain device as claimed in claim 1, wherein said curtain units are made of translucent fabric material.

9. The curtain device as claimed in claim 1, wherein said curtain units are made of opaque fabric material.

10. A curtain device for a plurality of Venetian blind slats, each of which has a top edge and a bottom edge opposite to the top edge in a vertical direction, said curtain device comprising:

a plurality of, curtain units arranged in a horizontal direction, each of said curtain units including a first curtain portion having a first vertical edge and a second vertical edge opposite to said first vertical edge, and a second curtain portion having a first vertical edge connected to said second vertical edge of said first curtain portion, and a second vertical edge opposite to said first vertical edge of said second curtain portion and connected to said first vertical edge of said first curtain portion of an adjacent one of said curtain units such that said second curtain portion cooperates with said firs curtain portion of the adjacent one of said curtain units to confine an accommodation space that is adapted to accommodate a respective one of the Venetian blind slats therein;

a plurality of anchoring members, each of which is mounted on a respective one of said curtain units, said anchoring members being adapted to anchor said curtain units on the top edges of the Venetian blind slats in said accommodation spaces, respectively; and a plurality of fastening members, each of which fastens removably said second curtain portion of a respective one of said curtain units to said first curtain portion of the adjacent one of said curtain units at an upper end of said accommodation space;

wherein each of said first and second curtain portions has a length in the vertical direction longer than that of the Venetian blind slats and further has a bottom edge to be disposed under the bottom edge of the respective one of the Venetian blind slats in said accommodation space, said curtain device further comprising a plurality of string units, each of which includes two opposite end knots and an intermediate string portion between said end knots, said intermediate string portion being strung through said bottom edge of said second curtain portion of a respective one of said curtain units and said bottom edge of said first curtain portion of the adjacent one of said curtain units.

11. The curtain device as claimed in claim 10, wherein each of said first and second curtain portions further has a top edge, said top edge of said second curtain portion of each of said curtain units having a section sewn to said top edge of said first curtain portion of the adjacent one of said curtain units proximate to said second vertical edge of said second curtain portion to form a hanging segment adapted for hanging on the top edge of the respective one of the Venetian blind slats in said accommodation space.

12. The curtain device as claimed in claim 10, wherein each of said fastening members includes a first fastening unit mounted on said second curtain portion of the respective one of said curtain units, and a second fastening unit mounted on said first curtain portion of the adjacent one of said curtain units, said second fastening unit being fastened removably to and being pivotable relative to said first fastening unit about a horizontal pivot axis.

13. The curtain device as claimed in claim 12, wherein said first and second fastening units are male and female fasteners, respectively.

14. The curtain device as claimed in claim 13, wherein one of said first and second fastening units is formed directly on a respective one of said anchoring members.

15. The curtain device as claimed in claim 10, wherein each of said curtain units has a width in the horizontal direction that is at least 1.5 times that of the Venetian blind slats.

16. The curtain device as claimed in claim 10, wherein said curtain units are made of transparent fabric material.

17. The curtain device as claimed in claim 10, wherein said curtain units are made of translucent fabric material.

18. The curtain device as claimed in claim 10, wherein said curtain units are made of opaque fabric material.

* * * * *